US006599047B1

(12) United States Patent
Lin

(10) Patent No.: US 6,599,047 B1
(45) Date of Patent: Jul. 29, 2003

(54) PEN

(76) Inventor: Wen-Shiung Lin, 5F, No. 10-1, Ho Ping Rd., Pan Chiao City, Taipei Hsien (TW)

( * ) Notice: Subject to any disclaimer, the term of this patent is extended or adjusted under 35 U.S.C. 154(b) by 0 days.

(21) Appl. No.: 10/285,537

(22) Filed: Nov. 1, 2002

(51) Int. Cl.[7] ..... B43K 5/18

(52) U.S. Cl. ..... 401/242; 401/89; 401/243; 401/222

(58) Field of Search ..... 401/242, 243, 401/249, 251, 222, 238, 89

(56) References Cited

U.S. PATENT DOCUMENTS 2,693,172 A * 11/1954 Miessner ..... 401/242
2,737,329 A * 3/1956 Bolsey ..... 401/242
2,796,850 A * 6/1957 Emerson ..... 401/242
2,871,825 A * 2/1959 Uchida et al. ..... 401/242

* cited by examiner

*Primary Examiner*—David J. Walczak
(74) *Attorney, Agent, or Firm*—Rosenberg, Klein & Lee

(57) ABSTRACT

A pen includes a reservoir tube holding a reservoir tube and a writing tip at one end for writing, a barrel fastened to one end of the reservoir tube remote from the writing tip by a connector to hold a barrel, a top cap capped on the barrel and adapted to hold a spare writing tip, a spring holder fixedly provided inside the barrel to hold a spring holder, and a movable stopper supported on a spring at the spring holder and adapted to open an air passage hole between the atmosphere and the inside space of the reservoir tube subject to the level of ink in the reservoir tube.

11 Claims, 6 Drawing Sheets

PEN

BACKGROUND OF THE INVENTION

1. Field of the Invention

The present invention relates to writing implements and, more particularly, to a pen that automatically guides in outside air pressure subject to the level of ink in the reservoir tube to smoothen the writing.

2. Description of the Related Art

A regular pen A1, as shown in FIG. 1, comprises a penholder A2 and an ink cartridge and writing tip assembly A3 provided in the penholder A2. This design of pen is not satisfactory in function because of the following drawbacks.

1. When the ink in the ink cartridge and writing tip assembly A3 used up, the whole ink cartridge and writing tip assembly A3 becomes useless and must be thrown away.
2. When the writing tip of the ink cartridge and writing tip assembly A3 is damaged by an accident, the writing tip cannot be replaced with a new one, and the ink cartridge and writing tip assembly A3 becomes useless and must be thrown away.

SUMMARY OF THE INVENTION

The present invention has been accomplished under the circumstances in view. It is the main object of the present invention to provide a pen, which enables the user to refill the desired color of ink. It is another object of the present invention to provide a pen, which uses a replaceable writing tip. It is still another object of the present invention to provide a pen, which is provided with a spare writing tip for replacing the main writing tip when the main writing tip damaged accidentally. It is still another object of the present invention toprovide a pen, which is suitable for industrial use. To achieve these and other objects of the present invention, the pen comprises a reservoir tube holding a reservoir tube and a writing tip at one end for writing, a barrel fastened to one end of the reservoir tube remote from the writing tip by a connector to hold a barrel, a top cap capped on the barrel and adapted to hold a spare writing tip, a spring holder fixedly provided inside the barrel to hold a spring holder, and a movable stopper supported on a spring at the spring holder and adapted to open an air passage hole between the atmosphere and the inside space of the reservoir tube subject to the level of ink in the reservoir tube.

DETAILED DESCRIPTION OF THE PREFERRED EMBODIMENT

Figure 1:
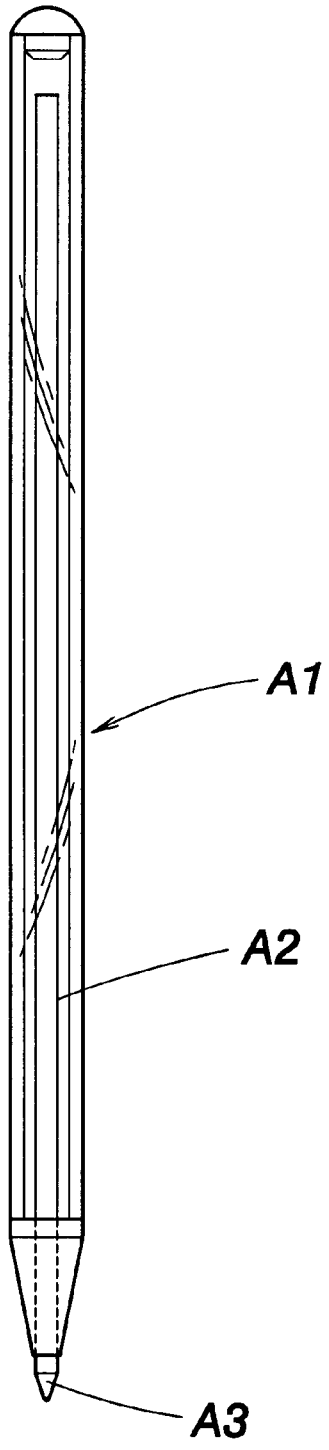
FIG. 1 PRIOR ART
FIG. 1 is a perspective view of a pen according to the prior art.
Figure 2:
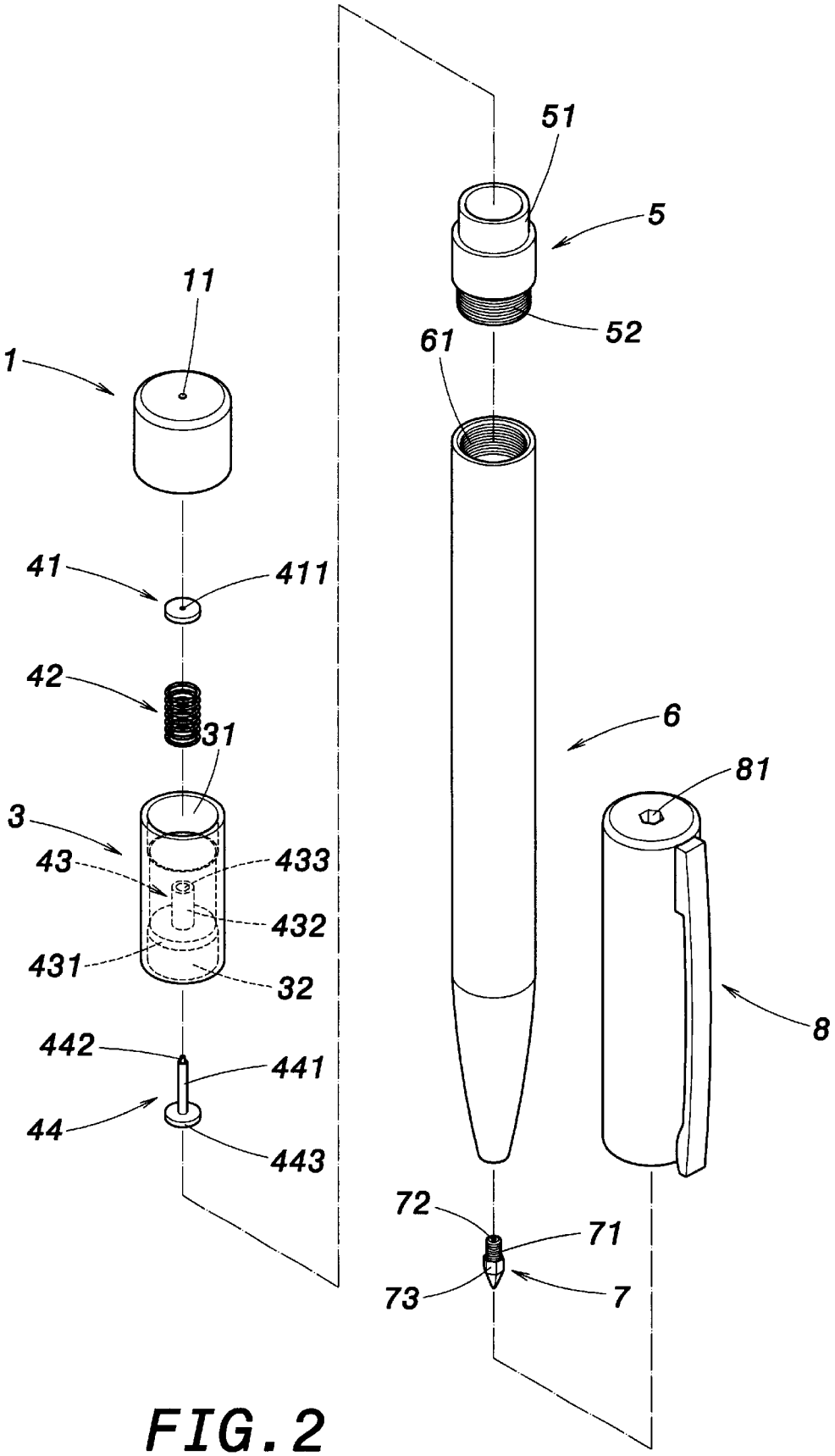
FIG. 2 is an exploded view of a pen according to the present invention.
Figure 3:
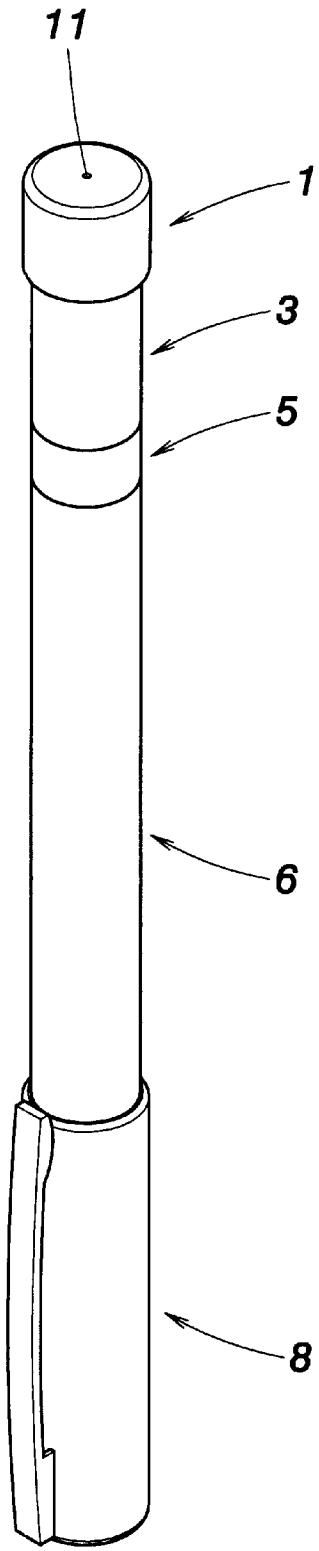
FIG. 3 is an elevational view of the pen according to the present invention.
Figure 4:
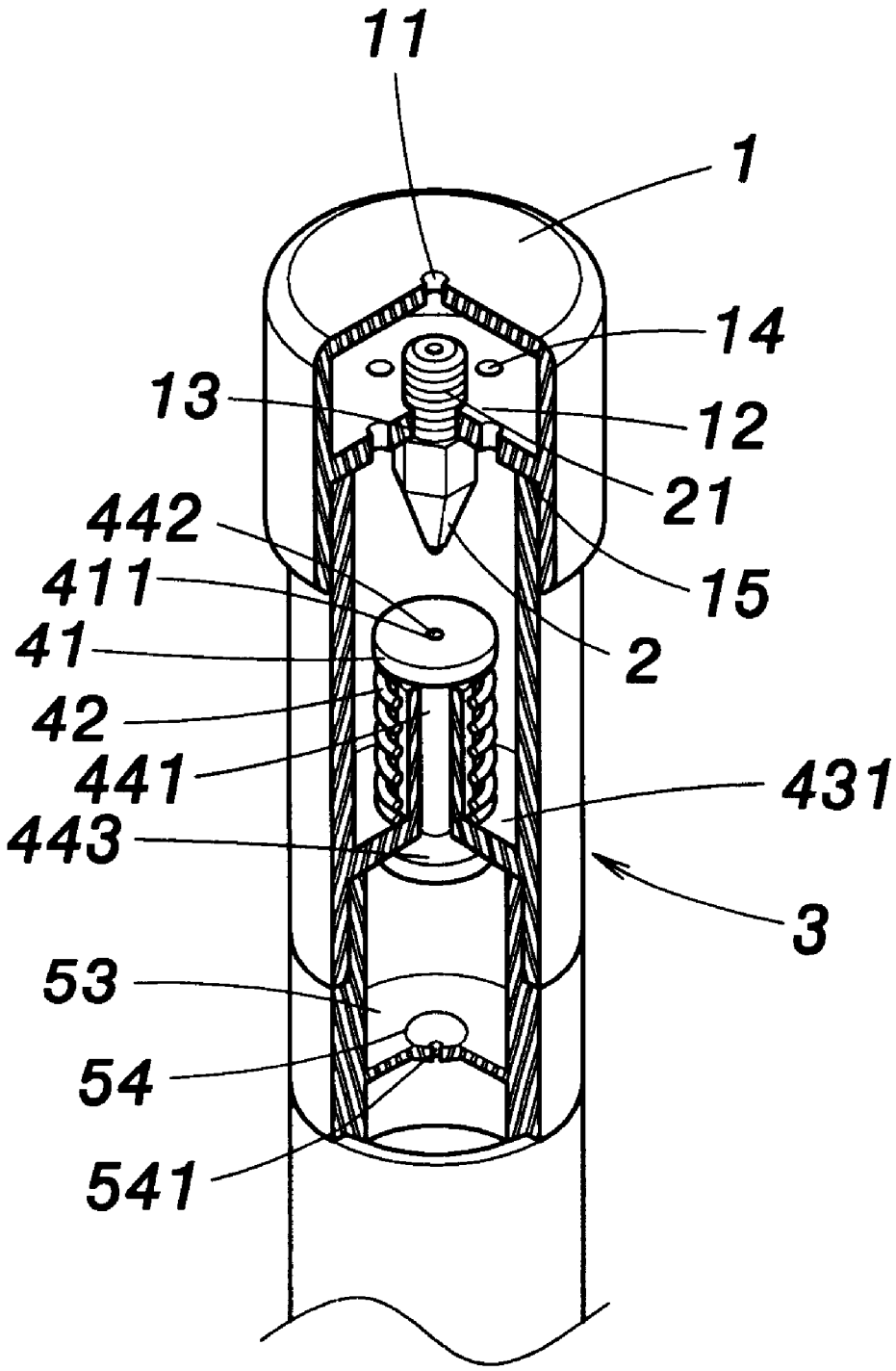
FIG. 4 is a sectional elevation in an enlarged scale of the upper part of the pen according to the present invention.
Figure 5:
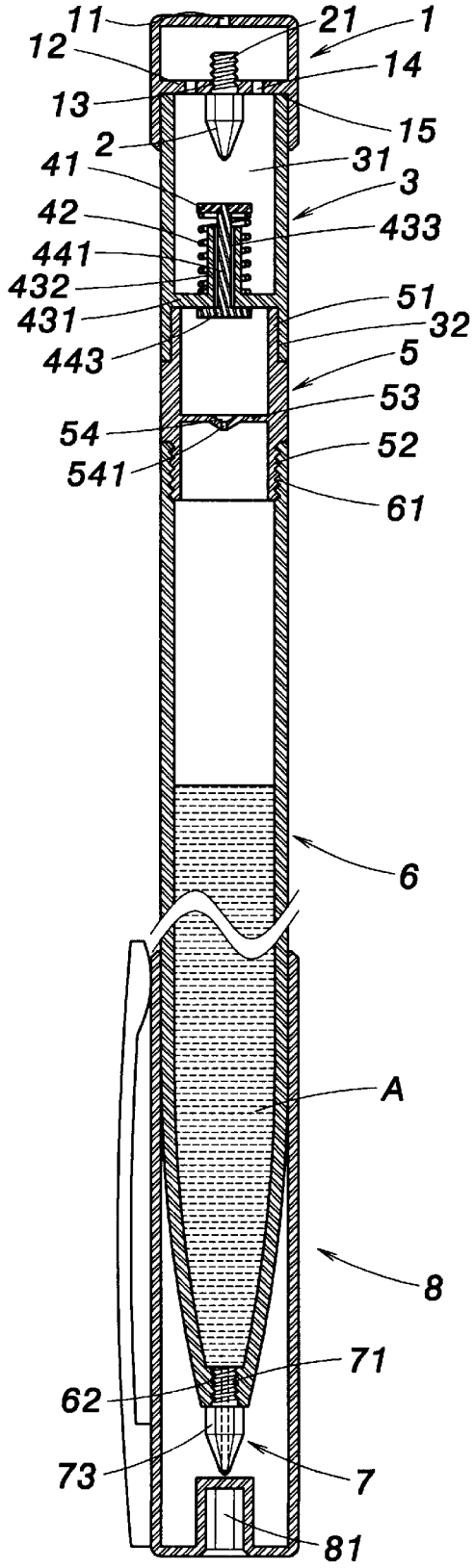
FIG. 5 is a front sectional plain view in an enlarged scale of the pen according to the present invention.

Referring to FIGS. from 2 through 5, a pen in accordance with the present invention is shown comprised of a top cap 1, a spare writing tip 2, a barrel 3, a locating plate 41, a compression spring 42, a spring holder 43, a movable stopper 44, a connector 5, a reservoir tube 6, a main writing tip 7, and a pen cap 8.

The top cap 1 is press-fitted onto the top open end of the barrel 3, having an air inlet 11 in the top center thereof, a transversely extended partition wall 12 spaced below the air inlet 11, a screw hole 13 in the center of the partition wall 12 and adapted to receive the threaded neck 21 of the spare writing tip 2, and a plurality of air holes 14 through the partition wall 12 in communication between the air inlet 11 and the inside space of the barrel 3.

The barrel 3 has a top open end 31 press-fitted into the top cap 1 from the bottom side and stopped at the bottom surface 15 of the partition wall 12, and a bottom open end 32. The spring holder 43 is fixedly provided inside the barrel 3 between the top open end and the bottom open end 32, having a base 431 sealed to the inside wall of the barrel 3, an upright stem 432 perpendicularly extended from the top center of the base 431, and an axial hole 433 axially extended through the upright stem 432 and the base 431. The compression spring 42 is sleeved onto the upright stem 432 of the spring holder 43 inside the barrel 3. When not compressed, the axial length of the compression spring 42 is longer than the upright stem 432. The movable stopper 44 comprises a stopper head 443 adapted to block the axial hole 433 of the spring holder 43, and a stopper rod 441 perpendicularly extended from the top center of the stopper head 443 and inserted through the axial hole 433 of the spring holder 43 from the bottom side. The stopper rod 441 has a top end terminating in a connecting tip 442. The locating plate 41 is fastened to the stopper rod 441 of the stopper 44 and supported on the compression spring 42 to secure the stopper 44 to the spring holder 43 having a center mounting hole 411 fastened to the connecting tip 442 of the stopper rod 441. The connector 5 is shaped like a stepped stub tube, having a top coupling portion 51 press-fitted into the bottom open end 32 of the barrel 3 and stopped at the bottom surface of the base 431 of the spring holder 43, a threaded bottom coupling portion 52, and a transverse partition wall 53 provided on the inside between the top coupling portion 51 and the threaded bottom coupling portion 52. The transverse partition wall 53 has a downwardly protruded center portion 54 and an air hole 541 through the downwardly protruded center portion 54. The reservoir tube 6 holds an ink A for writing, having a first inner thread 61 provided in the top end and threaded onto the threaded bottom coupling portion 52 of the connector 5 and a second inner thread 62 in provided in the tapered bottom end. The main writing tip 7 has a hexagonal cone body 73, a threaded neck 71 extended from the hexagonal cone body 73 and threaded into the second inner thread 62 of the reservoir tube 6, and a ink passage hole 72 axially extended through the threaded neck 71 and the hexagonal cone body 73 and adapted to guide the ink A from the reservoir tube 6 out of the main writing tip 7 for application to the surface of a sheet of paper or the like. The pen cap 8 is to be capped on the bottom end of the reservoir tube 6 to protect the main writing tip 7 and to close the ink passage 72. The pen cap 8 has a hexagonal center hole 81 fitting the hexagonal cone body 73 of the main writing tip 7. When the hexagonal center hole 81 attached to the hexagonal cone body 73 of the main writing tip 7, the pen cap 8 can be rotated to disconnect the main writing tip 7 from the second inner thread 62 of the reservoir tube 6.

Figure 6:
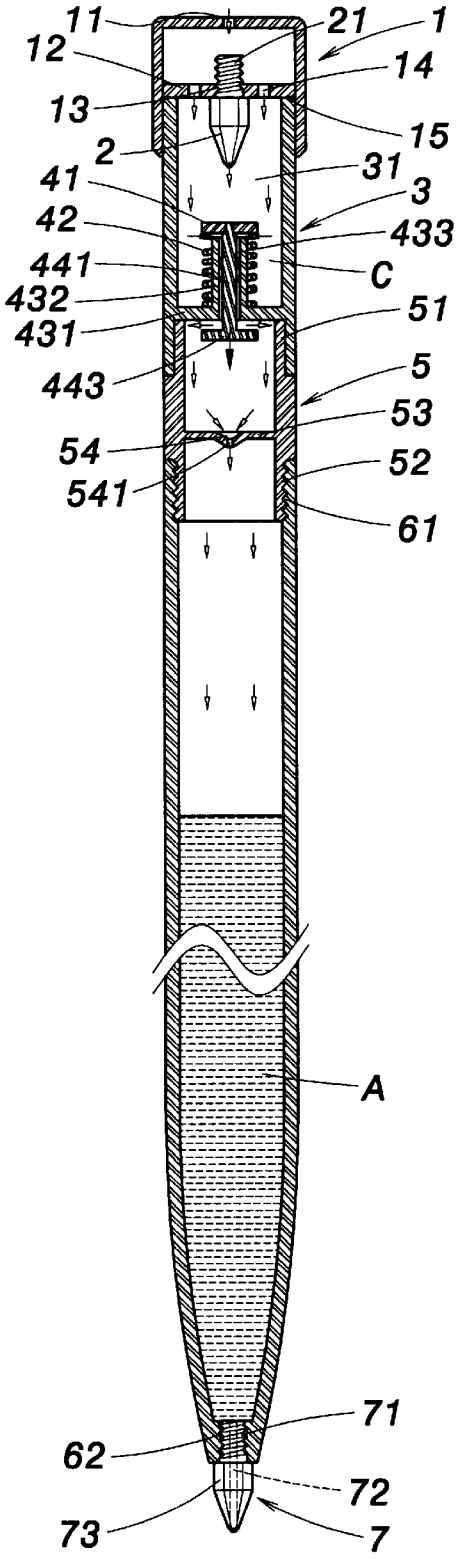
FIG. 6 is a schematic drawing showing the operation of the pen according to the present invention.

Referring to FIG. 6, when the level of the ink A is lowered in the reservoir tube 6 after long uses of the pen, outside air passes through the air inlet 11, the air hole 14, the axial hole 433 and the air hole 541 to force the locating plate 41 and the movable stopper 44 downwards against the compression spring 42, and then to pass to the inside of the reservoir tube 6, and therefore sufficient air pressure is provided in the reservoir tube 6 to force the ink A out of the main writing tip 7 during writing.

A prototype of pen has been constructed with the features of FIGS. 2~6. The pen functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A pen comprising:

a reservoir tube holding an ink for writing, said reservoir tube having a top end, a conical bottom end, and an inner thread in said conical bottom end;

a connector shaped like a stepped stub tube, said connector having a bottom coupling portion fastened to the top end of said reservoir tube, a top coupling portion, and a transverse partition wall provided on the inside between said top coupling portion and said bottom coupling portion, the transverse partition wall of said connector having a downwardly protruded center portion and an air hole through said downwardly protruded center portion;

a main writing tip, said main writing tip having a body, a threaded neck extended from said body and threaded into the inner thread in the conical bottom end of said reservoir tube, and a ink passage hole axially extended through the threaded neck and body of said main writing tip and adapted to guide the ink from said reservoir tube out of said main writing tip for application to the surface of a sheet of paper or the like;

a pen cap to be capped on the conical bottom end of said reservoir tube to protect said main writing tip and to close the ink passage of said main writing tip, said pen cap having a top center hole fitting the body of said main writing tip;

a barrel, said barrel having a top open end, and a bottom open end fastened to the top coupling portion of said connector;

a top cap fastened to the top open end of said barrel, said top cap having an air inlet in the center of a top thereof, a transversely extended partition wall spaced below said air inlet, a screw hole in the center of the partition wall of said top cap, and a plurality of air holes through the partition wall of said top cap in communication between said air inlet and the inside space of said barrel;

a spare writing tip received inside said top cap, said spare writing tip having a threaded neck for threading into the screw hole of said top cap;

a spring holder fixedly provided inside said barrel between the top open end and bottom open end of said barrel, said spring holder having a base sealed to an inside wall of said barrel, an upright stem perpendicularly extended from said base, and an axial hole axially extended through said upright stem and said base;

a compression spring sleeved onto said upright stem of said spring holder and supported on said base of said spring holder inside said barrel;

a movable stopper adapted to close/open the axial hole of said spring holder, said movable stopper comprising a stopper head adapted to block the axial hole of said spring holder, and a stopper rod perpendicularly upwardly extended from said stopper head and inserted through the axial hole of said spring holder from a bottom side, said stopper rod having a top end terminating in a connecting tip; and a locating plate fixedly fastened to the stopper rod of said stopper and supported on said compression spring to secure said stopper to said spring holder, said locating plate having a center mounting hole fastened to the connecting tip of said stopper rod.

2. The pen as claimed in claim 1, wherein said top cap is press-fitted onto the top open end of said barrel.

3. The pen as claimed in claim 1, wherein the body of said main writing tip is shaped like a hexagonal cone.

4. The pen as claimed in claim 1, wherein said spare writing tip has a hexagonal cone body fitting the center hole of said pen cap.

5. The pen as claimed in claim 1, wherein the top end of said reservoir tube has an inner thread; the bottom coupling portion of said connector is externally threaded and threaded into the inner thread of the top end of said reservoir tube.

6. The pen as claimed in claim 1, wherein the top coupling portion of said connector is press fitted into the bottom open end of said barrel.

7. A pen comprising:

a reservoir tube holding an ink for writing, said reservoir tube having a top end, a conical bottom end, and an inner thread in said conical bottom end;

a connector shaped like a stepped stub tube, said connector having a bottom coupling portion fastened to the top end of said reservoir tube, a top coupling portion, and a transverse partition wall provided on the inside between said top coupling portion and said bottom coupling portion, the transverse partition wall of said connector having a downwardly protruded center portion and an air hole through said downwardly protruded center portion;

a main writing tip, said main writing tip having a body, a threaded neck extended from said body and threaded into the inner thread in the conical bottom end of said reservoir tube, and a ink passage hole axially extended through the threaded neck and body of said main writing tip and adapted to guide the ink from said reservoir tube out of said main writing tip for application to the surface of a sheet of paper or the like;

a barrel, said barrel having a top open end, and a bottom open end fastened to the top coupling portion of said connector;

a top cap fastened to the top open end of said barrel, said top cap having an air inlet in the center of a top thereof, a transversely extended partition wall spaced below said air inlet, a screw hole in the center of the partition wall of said top cap, and a plurality of air holes through the partition wall of said top cap in communication between said air inlet and the inside space of said barrel;

a spring holder fixedly provided inside said barrel between the top open end and bottom open end of said barrel, said spring holder having a base sealed to an inside wall of said barrel, an upright stem perpendicularly extended from said base, and an axial hole axially extended through said upright stem and said base;

a compression spring sleeved onto said upright stem of said spring holder and supported on said base of said spring holder inside said barrel;

a movable stopper adapted to close/open the axial hole of said spring holder, said movable stopper comprising a stopper head adapted to block the axial hole of said spring holder, and a stopper rod perpendicularly upwardly extended from said stopper head and inserted through the axial hole of said spring holder from a bottom side, said stopper rod having a top end terminating in a connecting tip; and a locating plate fixedly fastened to the stopper rod of said stopper and supported on said compression spring to secure said stopper to said spring holder, said locating plate having a center mounting hole fastened to the connecting tip of said stopper rod.

8. The pen as claimed in claim 7, wherein said top cap is press-fitted onto the top open end of said barrel.

9. The pen as claimed in claim 7, wherein the body of said main writing tip is shaped like a hexagonal cone.

10. The pen as claimed in claim 7, wherein the top coupling portion of said connector is press fitted into the bottom open end of said barrel.

11. The pen as claimed in claim 7, wherein the top end of said reservoir tube has an inner thread; the bottom coupling portion of said connector is externally threaded and threaded into the inner thread of the top end of said reservoir tube.

* * * * *